US010008810B2

(12) United States Patent
Soudy et al.

(10) Patent No.: US 10,008,810 B2
(45) Date of Patent: Jun. 26, 2018

(54) ELECTRICAL CONNECTOR HAVING A SHIELDING MEMBER WITH TWO HALVES EACH WITH INWARDLY AND OUTWARDLY PROJECTING HOOKS

(71) Applicant: FCI USA LLC, Etters, PA (US)

(72) Inventors: Aymeric Soudy, Besancon (FR); Gert Droesbeke, Besancon (FR)

(73) Assignee: FCI USA LLC, Etters, PA (US)

( * ) Notice: Subject to any disclaimer, the term of this patent is extended or adjusted under 35 U.S.C. 154(b) by 0 days. days.

(21) Appl. No.: 15/558,085

(22) PCT Filed: Mar. 8, 2016

(86) PCT No.: PCT/US2016/021349
§ 371 (c)(1),
(2) Date: Sep. 13, 2017

(87) PCT Pub. No.: WO2016/149890
PCT Pub. Date: Sep. 22, 2016

(65) Prior Publication Data

US 2018/0054027 A1 Feb. 22, 2018

Related U.S. Application Data

(60) Provisional application No. 62/132,865, filed on Mar. 13, 2015.

(51) Int. Cl.
*H01R 13/627* (2006.01)
*H01R 13/648* (2006.01)
(Continued)

(52) U.S. Cl.
CPC ..... *H01R 13/6581* (2013.01); *H01R 13/506* (2013.01); *H01R 13/6271* (2013.01); *H01R 13/6593* (2013.01)

(58) Field of Classification Search
CPC ..... H01R 13/6271; H01R 13/6273; H01R 13/6275; H01R 13/6581; H01R 13/6582; H01R 13/6593; H01R 13/6598
(Continued)

(56) References Cited

U.S. PATENT DOCUMENTS 4,938,710 A 7/1990 Aihara et al.
5,475,781 A 12/1995 Chang et al.
(Continued)

FOREIGN PATENT DOCUMENTS

JP 3109576 U 5/2005

OTHER PUBLICATIONS

International Search Report and Written Opinion for International Application No. PCT/US2016/021349 dated Jun. 17, 2016.

*Primary Examiner* — Chandrika Prasad
(74) *Attorney, Agent, or Firm* — Wolf, Greenfield & Sacks, P.C.

(57) ABSTRACT

An electrical connector including a housing; electrical contacts connected to the housing; and a shield cover connected to the housing. The shield cover includes a first cover member and a second cover member. The shield cover surrounds the housing. The first cover member includes a first cover member latching section having a first lateral side with inward projecting hooks and an opposite second lateral side with outward projecting hooks. The second cover member has a second cover member latching section with a first lateral side with inward projecting hooks and an opposite second lateral side with outward projecting hooks. The inward projecting hooks of the first cover member latching section is latched to the outward projecting hooks of the second cover member latching section, and the inward projecting hooks of the second cover member latching
(Continued)

section is latched to the outward projecting hooks of the first cover member latching section.

11 Claims, 9 Drawing Sheets

(51) Int. Cl.
*H01R 13/6581* (2011.01)
*H01R 13/506* (2006.01)
*H01R 13/6593* (2011.01)

(58) Field of Classification Search
USPC ..... 439/607.54, 607.55, 607.56, 350, 352, 439/353
See application file for complete search history.

(56) References Cited

U.S. PATENT DOCUMENTS

| | | | | | |
|---|---|---|---|---|---|
| 6,039,606 | A * | 3/2000 | Chiou | ..... | H01R 13/506 439/607.45 |
| 6,165,016 | A | 12/2000 | Lai | | |
| 7,252,548 | B2 * | 8/2007 | Huang | ..... | H01R 24/60 439/607.01 |
| 2005/0255752 | A1 * | 11/2005 | Huang | ..... | H01R 24/60 439/607.01 |
| 2012/0129398 | A1 * | 5/2012 | Droesbeke | ..... | H01R 13/6594 439/607.55 |

* cited by examiner

ELECTRICAL CONNECTOR HAVING A SHIELDING MEMBER WITH TWO HALVES EACH WITH INWARDLY AND OUTWARDLY PROJECTING HOOKS

RELATED APPLICATIONS

This application is the U.S. National Stage of and claims priority to and the benefit of International Patent Application Number PCT/US2016/021349, entitled "ELECTRICAL CONNECTOR" filed on Mar. 8, 2016, which claims priority under 35 U.S.C. § 119(e) to U.S. Provisional Application Ser. No. 62/132,865, entitled "ELECTRICAL CONNECTOR" filed on Mar. 13, 2015. The entire contents of these applications are incorporated herein by reference in their entirety.

BACKGROUND

Technical Field

The exemplary and non-limiting embodiments relate generally to an electrical connector and, more particularly, to an electrical connector having a shield cover.

Brief Description of Prior Developments

Electrical connectors are known which have a shield cover.

SUMMARY

The following summary is merely intended to be exemplary. The summary is not intended to limit the scope of the claims.

In accordance with one aspect, an electrical connector is provided comprising a housing; electrical contacts connected to the housing; a shield cover connected to the housing, where the shield cover comprising a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the inward projecting hooks of the first cover member latching section is latched to the outward projecting hooks of the second cover member latching section, and where the inward projecting hooks of the second cover member latching section is latched to the outward projecting hooks of the first cover member latching section.

In accordance with another aspect, an example method comprises providing a housing; inserting electrical contacts into the housing; and connecting a shield cover to the housing, where the shield cover comprises a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the inward projecting hooks of the first cover member latching section is latched to the outward projecting hooks of the second cover member latching section, and where the inward projecting hooks of the second cover member latching section is latched to the outward projecting hooks of the first cover member latching section.

In accordance with another aspect, an example electrical connector comprises a housing; electrical contacts connected to the housing; a shield cover connected to the housing, where the shield cover comprising a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the first cover member latching section and the second cover member latching section have hermaphrodite shapes relative to each other.

In accordance with another aspect, an example method comprises providing a housing; inserting electrical contacts into the housing; and connecting a shield cover to the housing, where the shield cover comprises a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the first cover member latching section and the second cover member latching section have hermaphrodite shapes relative to each other.

In accordance with another aspect, an example electrical connector comprises a housing; electrical contacts connected to the housing; and a shield cover connected to the housing, where the shield cover comprising a first cover member and a second cover member, where the shield cover surrounds the housing, where the first and second cover members form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section.

In accordance with another aspect, an example method comprises providing a housing; inserting electrical contacts into the housing; and connecting a shield cover to the housing, where the shield cover comprises a first cover member and a second cover member, where the shield cover surrounds the housing, where the first and second cover members form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section.

In accordance with another aspect, an example electrical connector comprises a housing; electrical contacts connected to the housing; and a shield cover connected to the housing, where the shield cover comprising a first cover member and a second cover member, where the shield cover surrounds the housing, where the first cover member comprises a lateral side with a first extension extending inward into a first lateral side of the housing, where the first extension extends into a mating connector receiving area of the housing and comprises a front edge forming a stop for a mating connector inserted into the mating connector receiving area of the housing, and where the second cover member comprises a lateral side with a second extension extending inward into a second lateral side of the housing, where the second extension extends into the mating connector receiving area of the housing and comprises a front edge forming a stop for the mating connector inserted into the mating connector receiving area of the housing.

In accordance with another aspect, an example method comprises providing a housing; inserting electrical contacts into the housing; and connecting a shield cover to the housing, where the shield cover comprises a first cover member and a second cover member, where the shield cover surrounds the housing, where the first cover member comprises a lateral side with a first extension extending inward into a first lateral side of the housing, where the first extension extends into a mating connector receiving area of the housing and comprises a front edge forming a stop for a mating connector inserted into the mating connector receiving area of the housing, and where the second cover member comprises a lateral side with a second extension extending inward into a second lateral side of the housing, where the second extension extends into the mating connector receiving area of the housing and comprises a front edge forming a stop for the mating connector inserted into the mating connector receiving area of the housing.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
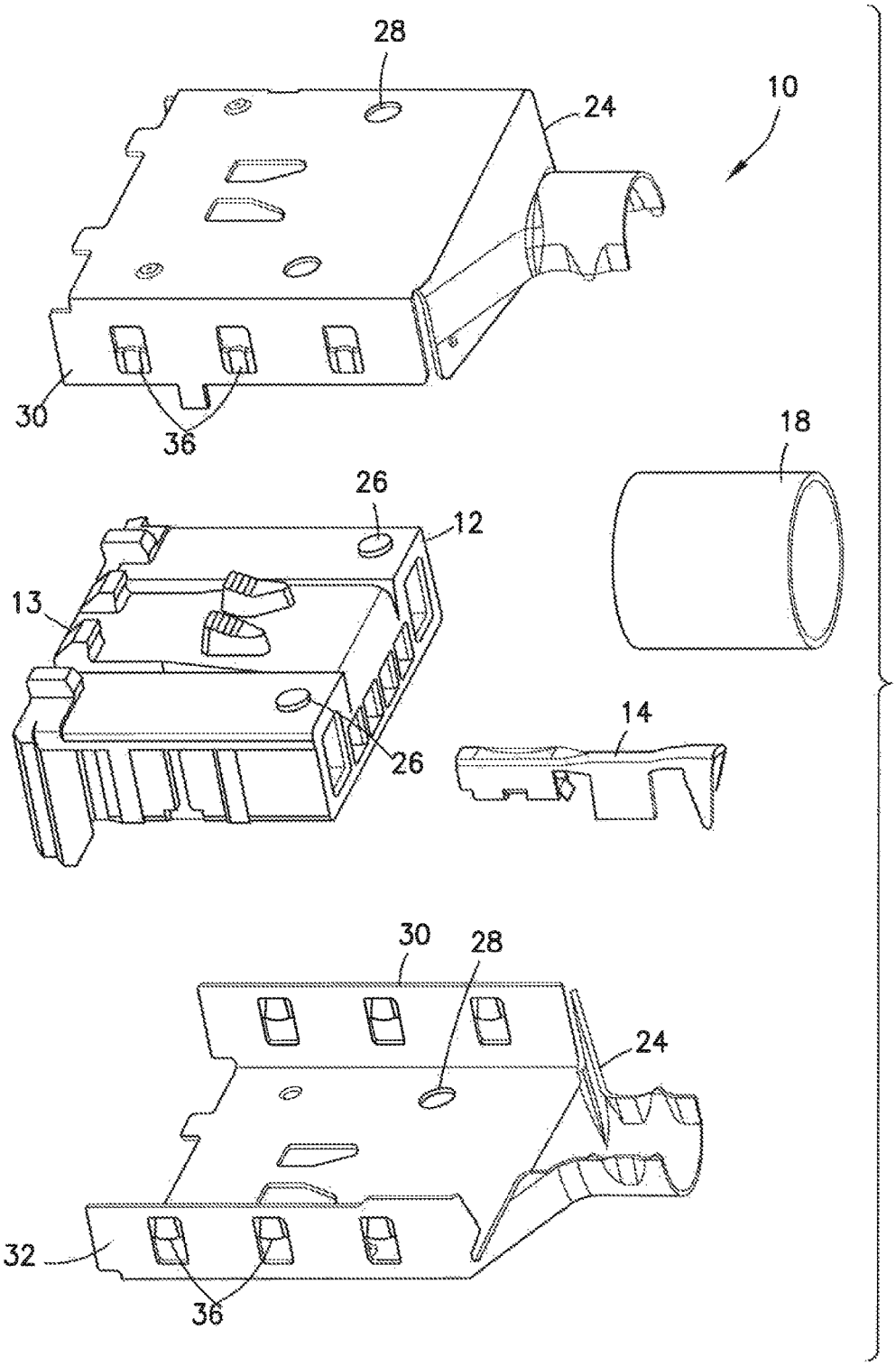
FIG. 1 is an exploded perspective view of an example electrical connector.

Referring to FIG. 1, there is shown an exploded perspective view of an electrical connector 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

Figure 2:
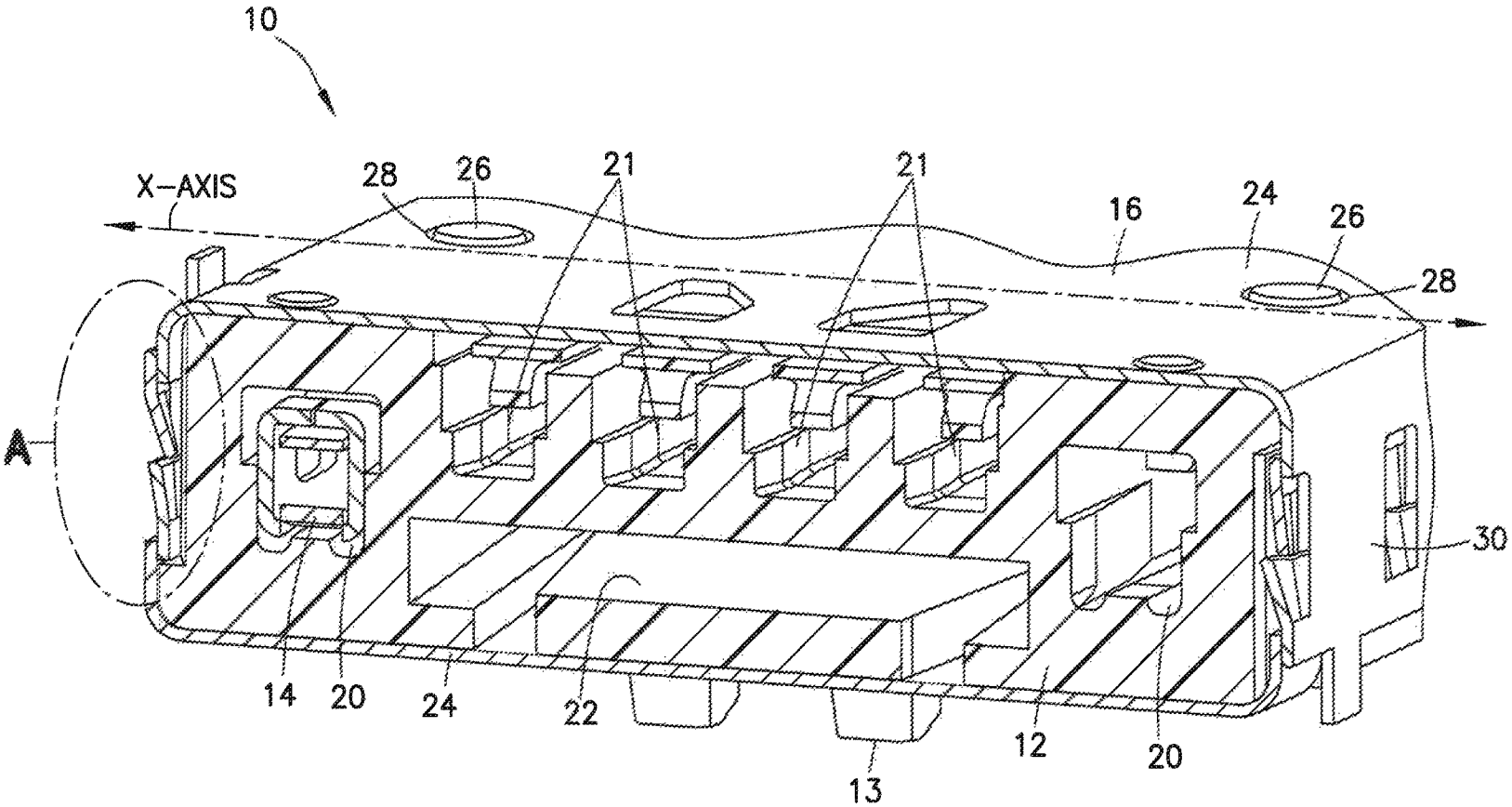
FIG. 2 is a cross sectional view of the connector shown in FIG. 1.

The connector 10 in this example provides a shielded cable-to-board hybrid design. However, features as described herein are not limited to cable-to-board designs. Referring also to FIG. 2, which is a cross sectional view of the connector shown in FIG. 1, the connector 10 generally comprises a housing 12, electrical contacts 14 (only one of which is shown), a shield cover 16 and a crimp ferrule 18. The contacts, in this example, comprise two power contacts at the outer lateral ends of the housing and four signal contacts. However, any suitable number and arrangement of signal and/or power contacts may be provided in alternate example embodiments. The housing 12, in this example, is a one piece member made of molded plastic or polymer material. The housing 12 has contact receiving areas 20, 21 configured to receive the electrical contacts 14, and an area 22 in which the on-molded locking latch 13 of the cable connector housing 12 can flex in order to self-latch in the board connector housing 54 of the mating connector 50 shown in FIGS. 12 and 13, or be pushed down so that the cable connector 10 can be unlocked from and then be unmated out of the board connector 50. However, in alternate examples, any suitably shaped housing and electrical contacts could be provided.

The shield cover 16 comprises two cover halves 24 which, in this example, are identical to each other to form hermaphrodite cover halves. However, in alternate examples the cover halves might not be identical. The cover comprises metal in order to function as a shield for the connector. Each hermaphrodite cover half 24 is at least partially kept in position by means of the cable connector housing 12. In this example pegs 26 of the housing 12 fit within circular cut-out 28 of each of the cover halves 24.

Figure 3A:
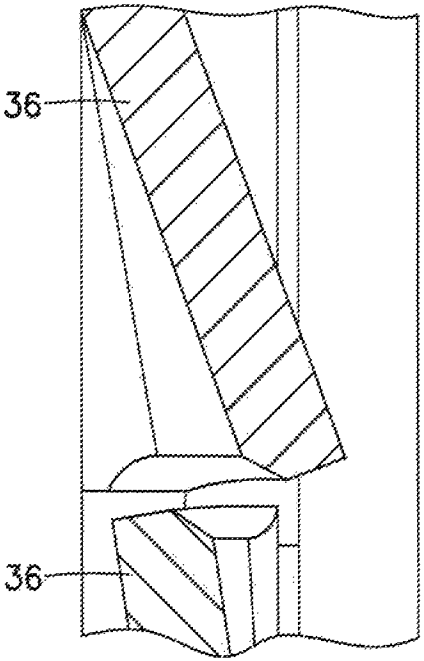
FIG. 3A is a partial enlarged view of a portion of the area shown in FIG. 3.
Figure 3:
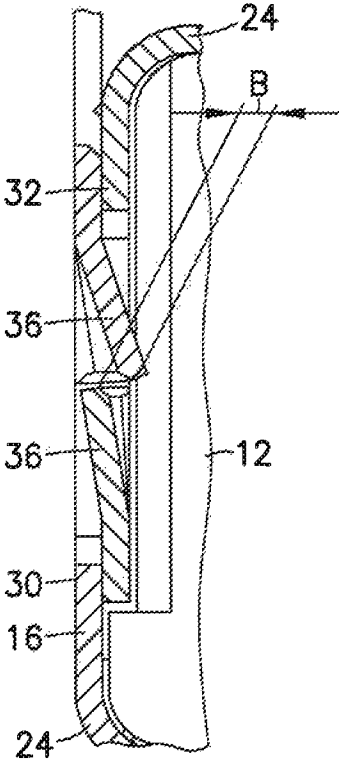
FIG. 3 is an enlarged view of area A in FIG. 2.

Referring also to FIG. 3, an enlarged portion A of FIG. 2 is shown. Because of the design of the latches 36 (see FIGS. 1, 3, 3A), when the cover halves 24 are mounted over the housing 12 both sides 30, 32 of each cover half 24 have the tendency to slide along and then hook behind each other. The latches 36 are half-barrel shaped indentions that cooperate to hold the two hermaphroditic cover members 24 together. Holes are provided at the ends of the half-barrel shapes for the latches of the mating half covers. Each cover half 24 has an outward side wall 30 and an opposite inward side wall 32. The outward side walls 30 of the cover halves 24 are clipped onto the inward side walls 32 of the twin cover half underneath them. This establishes the overlap "B" which will keep both cover halves 24 trapped onto each other. "B" is bigger than the freedom that both hermaphrodite cover halves can move apart onto the housing in opposite directions along the X-direction shown in FIG. 2.

Figure 4:
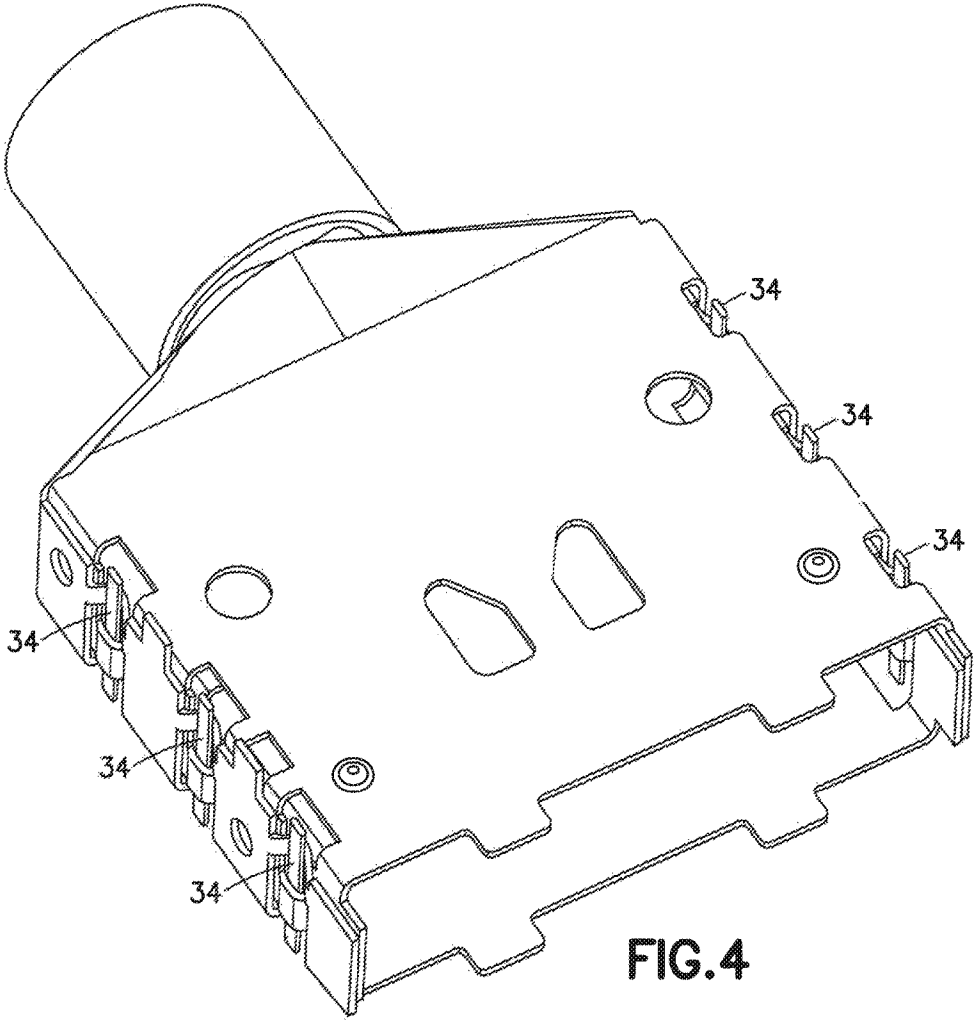
FIG. 4 is a perspective view of an alternate example of the shield cover of the electrical connector shown in FIG. 1.
Figure 6:
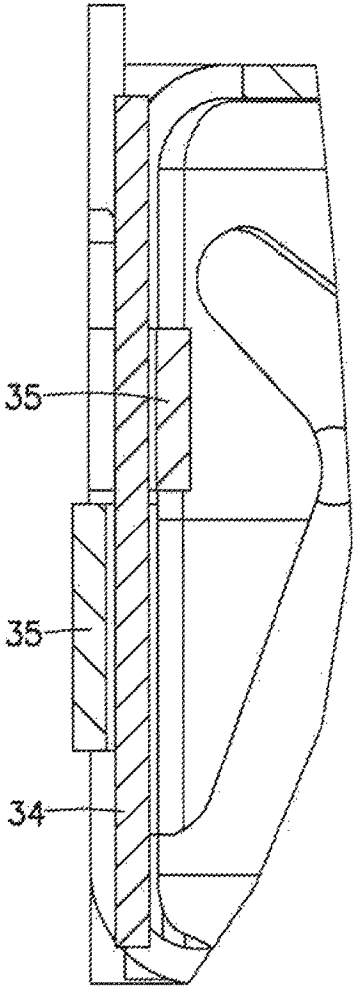
FIG. 6 is a partial cross sectional view of the enlarged portion shown in FIG. 5.
Figure 5:
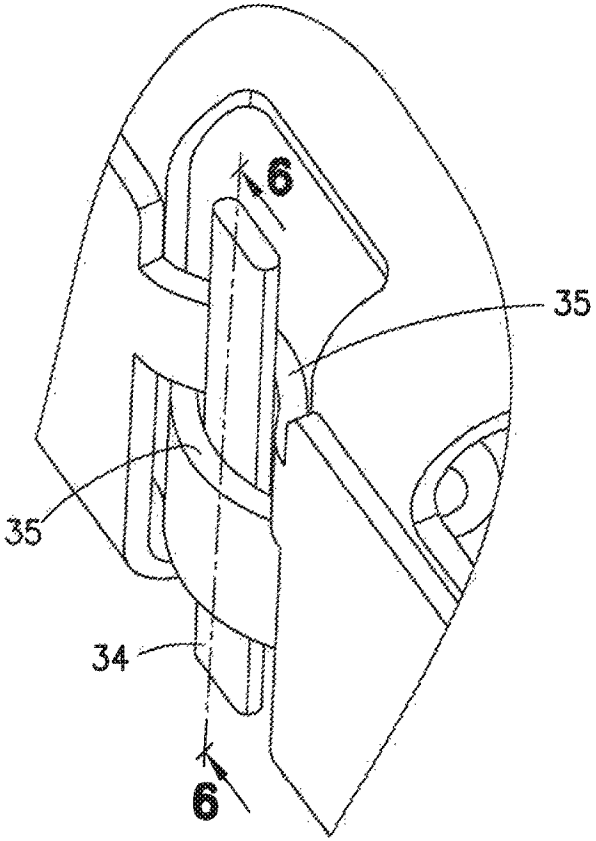
FIG. 5 is an enlarged view of a portion of the shield cover shown in FIG. 4.
Figure 7:
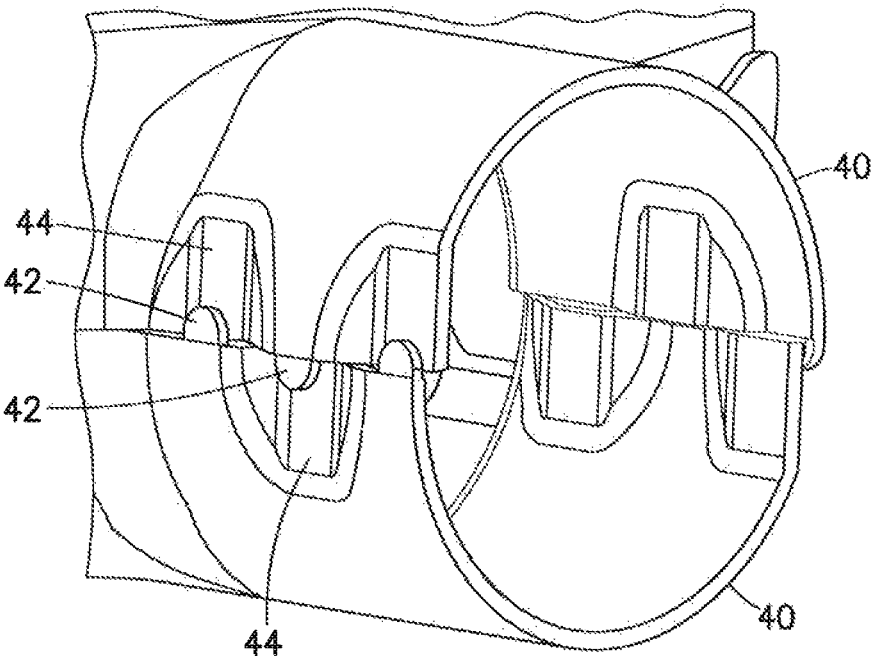
FIG. 7 is a partial perspective view of a portion of the cable exit section of the shield covers shown in FIGS. 1 and 4.
Figure 8:
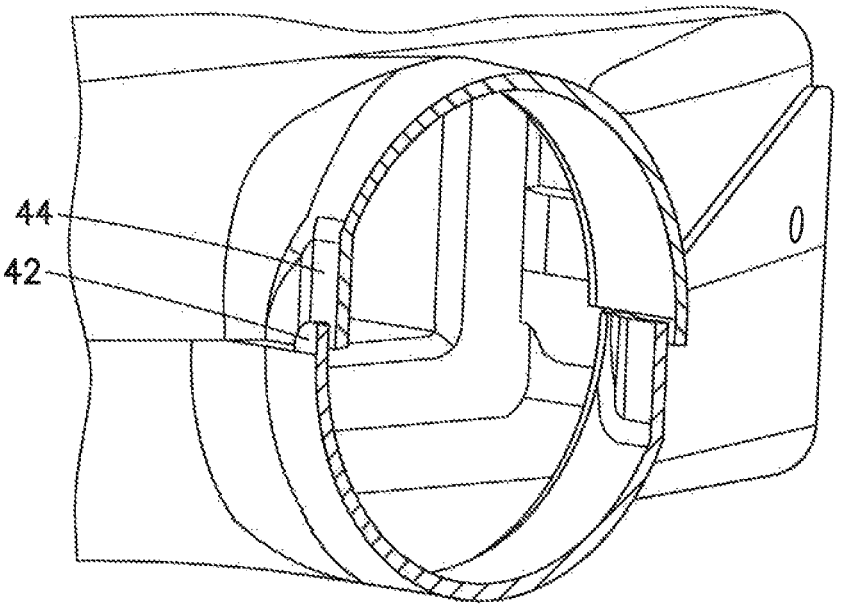
FIG. 8 is a cross sectional view of the portion of the cable exit section shown in FIG. 7.
Figure 9:
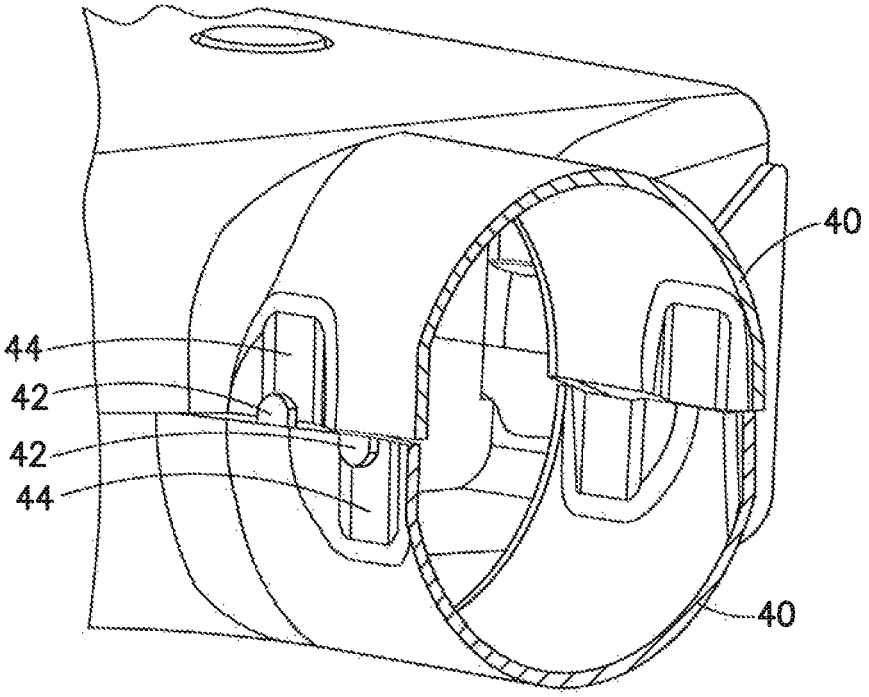
FIG. 9 is a cross sectional view of the portion of the cable exit section shown in FIG. 7.
Figure 10:
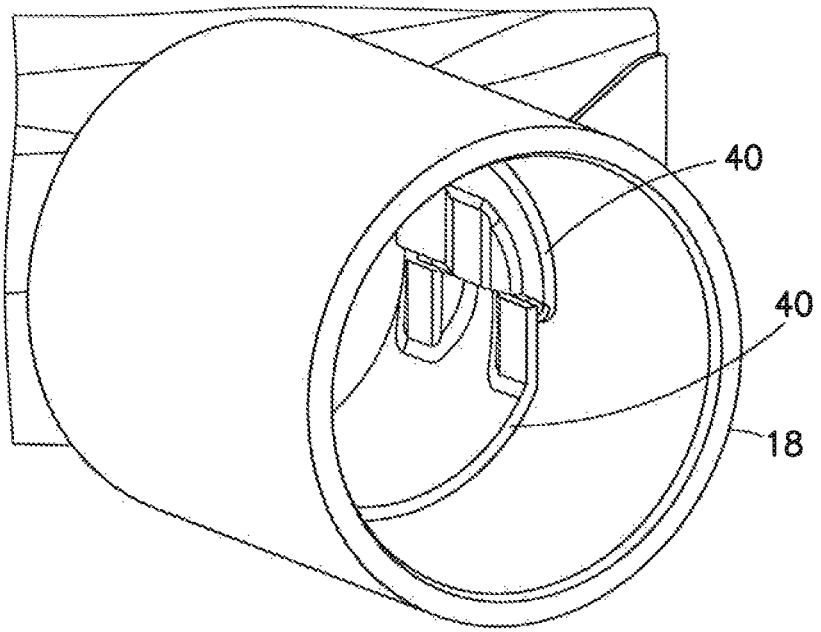
FIG. 10 shows the crimp ferrule of the cable exit section attached to the portion of the cable exit section shown in FIG. 7.
Figure 11:
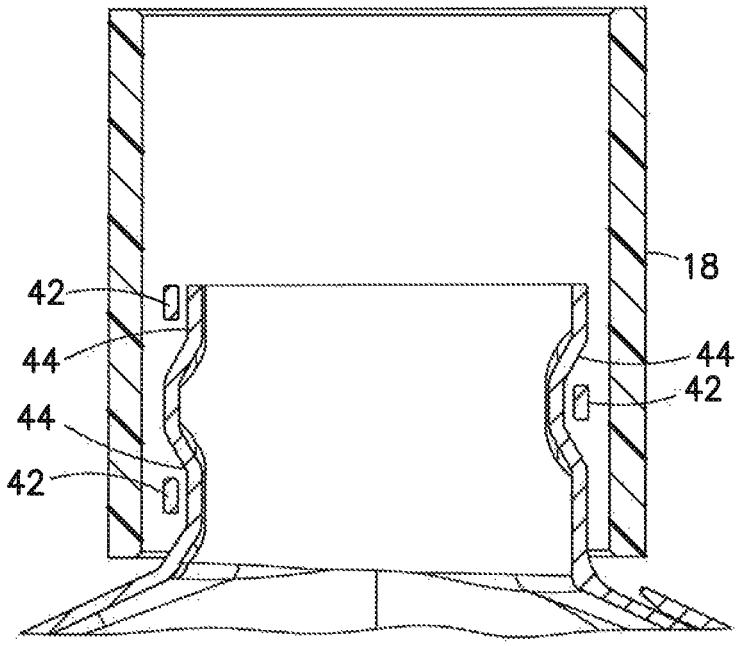
FIG. 11 shows the crimp ferrule cut away to see the portion of the cable exit section of FIG. 10 in cross section.

FIGS. 4-6 show an alternative variation on the hermaphrodite cover half locking which comprises wedges 34. The wedges 34 form pins that slide through an opening between the two half-barrel shaped indentions 35. The cover shells are hermaphroditic. To lock both hermaphrodite cover halves onto each other the wedges 34 are used. All the wedges could be merged into one piece. Thus, the closure of the cover halves could be done on the outside of the cover halves instead of the via cable connector housing within.

Referring also to FIGS. 7-11, self-aligning and supporting cable exit halves of the cover halves 24 are shown. Each hermaphrodite cover half 24 has a half circular cable exit 40 with teeth/extensions 42 and chambers 44 to receive the teeth/extensions of the other twin cover half. This provides a staggered interference fit. The teeth 42 and indention chambers 44 alternate. The cover shells are hermaphroditic. The exits 40 may be placed both onto each other with the assembled cover halves aligning and supporting each to such an extent that they will become a ring which will withstand the deformation of the ferrule 18 crimped all around them.

Figure 13:
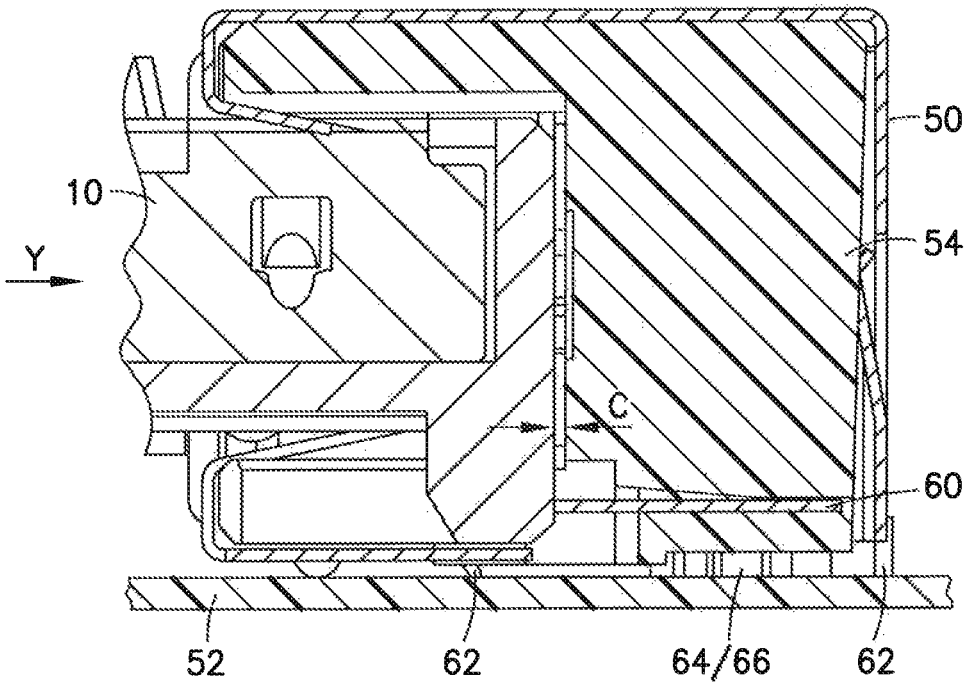
FIG. 13 a cross sectional view of the connector shown in FIG. 1 mated with the mating connector shown in FIG. 12.
Figure 12:
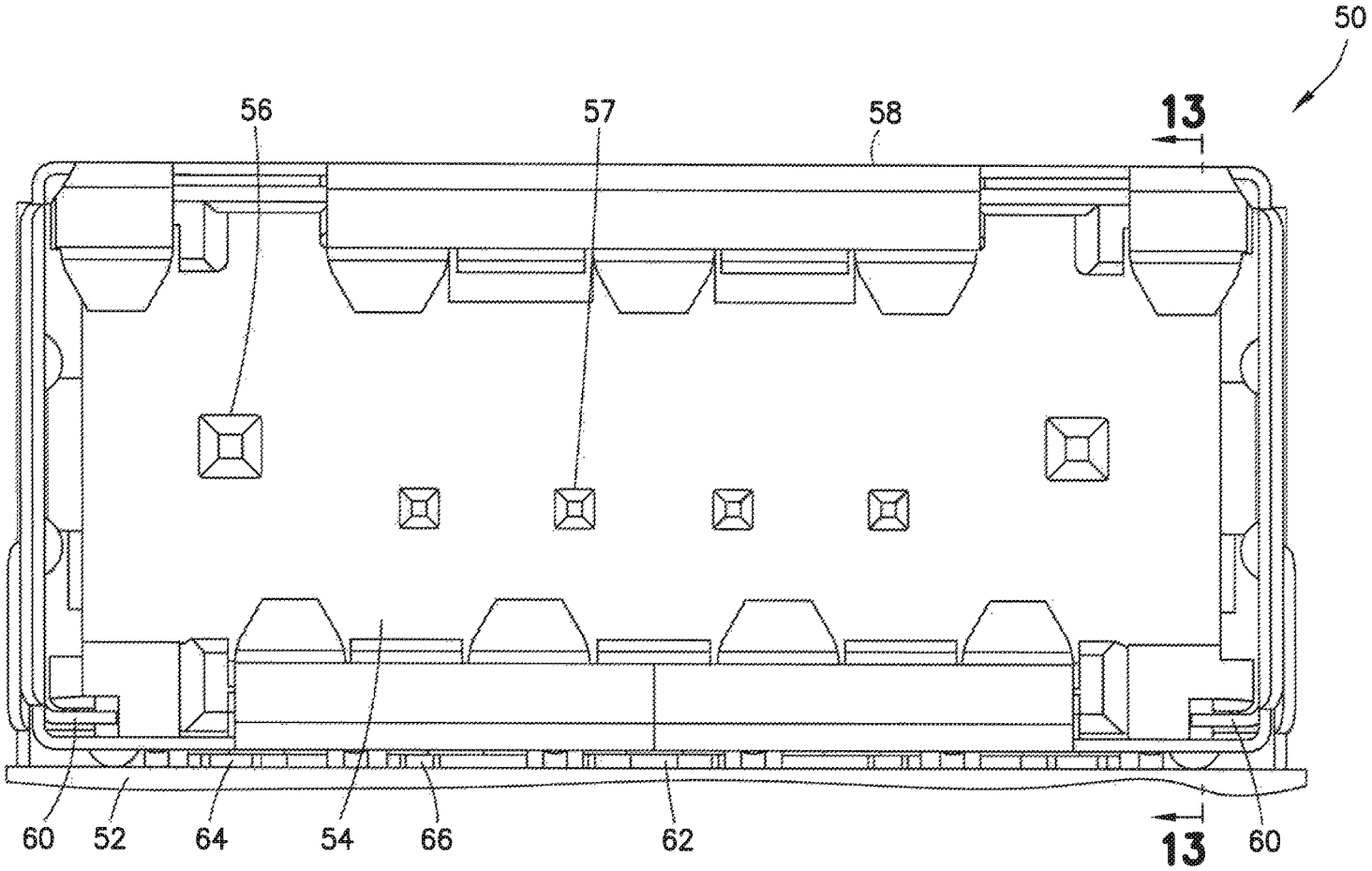
FIG. 12 is a front end view of a mating electrical connector configured to mate with the electrical connectors shown in FIG. 1.

FIGS. 12-13 show the mating electrical connector 50. The connector 50 is shown attached to a printed circuit board 52. The connector 50 comprises a housing 54, electrical terminal pins 56, 57, and a cover 58 forming a board connector shielding. Stress relief of the solder joints for the power pins 56 and signal pins 57 is provided. Inwards bended extensions 60 of the board connector shield 58 are provided against which the cable connector housing 12 collide when the two connectors 10, 50 are mated. On the left and right hand sides of the board connector shield 58 portions have been bend inwards, so that they can act as hard stops 60 for the cable connector mated inside. As such, they can keep the clearance "C" between the two housings 12, 54. In doing so, the mating forces in the direction "Y" will be taken by the solder joints 62 of the board connector shield 58, and not the solder joints 64 of the power terminal pins 56 and the solder joints 66 of the signal terminal pins 57. As shown in FIGS. 12-13, the shield 58 is folded into the cavity to form the stops 60 for the mating cable connector 10. The cover 58 may comprise cover halves which are attached to each other such as the cover halves 24.

The above description describes several examples ways of connecting two metal connector housings together. The clam-shell cover 16 may comprise cover members which are comprised of die cast material.

An example embodiment may be provided in an electrical connector comprising a housing; electrical contacts connected to the housing; and a shield cover connected to the housing, where the shield cover comprising a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the inward projecting hooks of the first cover member latching section is latched to the outward projecting hooks of the second cover member latching section, and where the inward projecting hooks of the second cover member latching section is latched to the outward projecting hooks of the first cover member latching section.

The inward and outward projecting hooks may have a same shape and are orientated in different directions. The inward and outward projecting hooks of the first cover member latching section and the second cover member latching section may be sized and shaped such that the inward and outward projecting hooks of the first cover member latching section pass by the inward and outward projecting hooks of the second cover member latching section before the inward and outward projecting hooks of the first cover member latching section latch to inward and outward projecting hooks of the second cover member latching section. The first cover member latching section and the second cover member latching section may have hermaphrodite shapes relative to each other. The first and second cover members may form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section. The at least one wedge may comprise a wedge section inserted between mating pairs of the inward and outward projecting hooks. The first cover member and the second cover member may be substantially identical and reversely orientated relative to each other. The first cover member may comprise a lateral side with a first extension extending inward into a first lateral side of the housing, where the first extension extends into a mating connector receiving area of the housing and comprises a front edge forming a stop for a mating connector inserted into the mating connector receiving area of the housing, and where the second cover member comprises a lateral side with a second extension extending inward into a second lateral side of the housing, where the second extension extends into the mating connector receiving area of the housing and comprises a front edge forming a stop for the mating connector inserted into the mating connector receiving area of the housing.

An electrical connector assembly may be provided comprising the electrical connector as described above; and a mating electrical connector comprising: a second housing; second electrical contacts connected to the second housing; a second shield cover connected to the housing, where the second shield cover comprising a first cover member and a second cover member, where the second shield cover surrounds the second housing, where the first cover member of the second shield cover comprises a first cover member latching section comprising a first lateral side with inward projecting hooks and an opposite second lateral side with outward projecting hooks, where the second cover member of the second shield cover comprises a second cover member latching section comprising a first lateral side with inward projecting hooks and an opposite second lateral side with outward projecting hooks, where the first cover member of the second shield cover comprises a lateral side with a first extension extending inward into a first lateral side of the second housing, where the first extension extends into a mating connector receiving area of the second housing and comprises a front edge forming a stop for the electrical connector inserted into the mating connector receiving area of the second housing, and where the second cover member of the second shield cover comprises a lateral side with a second extension extending inward into a second lateral side of the second housing, where the second extension extends into the mating connector receiving area of the second housing and comprises a front edge forming a stop for the electrical connector inserted into the mating connector receiving area of the housing.

An example method may comprise providing a housing; inserting electrical contacts into the housing; and connecting a shield cover to the housing, where the shield cover comprises a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the inward projecting hooks of the first cover member latching section is latched to the outward projecting hooks of the second cover member latching section, and where the inward projecting hooks of the second cover member latching section is latched to the outward projecting hooks of the first cover member latching section.

An embodiment may be provided in an electrical connector comprising a housing; electrical contacts connected to the housing; and a shield cover connected to the housing, where the shield cover comprising a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the first cover member latching section and the second cover member latching section have hermaphrodite shapes relative to each other.

An example method may comprise providing a housing; inserting electrical contacts into the housing; and connecting a shield cover to the housing, where the shield cover comprises a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the first cover member latching section and the second cover member latching section have hermaphrodite shapes relative to each other.

An example embodiment may be provided in an electrical connector comprising a housing; electrical contacts connected to the housing; and a shield cover connected to the housing, where the shield cover comprising a first cover member and a second cover member, where the shield cover surrounds the housing, where the first and second cover members form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section.

An example method may comprise providing a housing; inserting electrical contacts into the housing; and connecting a shield cover to the housing, where the shield cover comprises a first cover member and a second cover member, where the shield cover surrounds the housing, where the first and second cover members form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section.

An embodiment may be provided in an electrical connector comprising a housing; electrical contacts connected to the housing; and a shield cover connected to the housing, where the shield cover comprising a first cover member and a second cover member, where the shield cover surrounds the housing, where the first cover member comprises a lateral side with a first extension extending inward into a first lateral side of the housing, where the first extension extends into a mating connector receiving area of the housing and comprises a front edge forming a stop for a mating connector inserted into the mating connector receiving area of the housing, and where the second cover member comprises a lateral side with a second extension extending inward into a second lateral side of the housing, where the second extension extends into the mating connector receiving area of the housing and comprises a front edge forming a stop for the mating connector inserted into the mating connector receiving area of the housing.

An example method may comprise providing a housing; inserting electrical contacts into the housing; and connecting a shield cover to the housing, where the shield cover comprises a first cover member and a second cover member, where the shield cover surrounds the housing, where the first cover member comprises a lateral side with a first extension extending inward into a first lateral side of the housing, where the first extension extends into a mating connector receiving area of the housing and comprises a front edge forming a stop for a mating connector inserted into the mating connector receiving area of the housing, and where the second cover member comprises a lateral side with a second extension extending inward into a second lateral side of the housing, where the second extension extends into the mating connector receiving area of the housing and comprises a front edge forming a stop for the mating connector inserted into the mating connector receiving area of the housing.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An electrical connector comprising:

a housing;

electrical contacts connected to the housing;

a shield cover connected to the housing, where the shield cover comprises a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the inward projecting hooks of the first cover member latching section is latched to the outward projecting hooks of the second cover member latching section, and where the inward projecting hooks of the second cover member latching section is latched to the outward projecting hooks of the first cover member latching section.

2. The electrical connector as in claim 1 where the inward and outward projecting hooks have a same shape and are orientated in different directions.

3. The electrical connector as in claim 1, where the inward and outward projecting hooks of the first cover member latching section and the second cover member latching section are sized and shaped such that the inward and outward projecting hooks of the first cover member latching section pass by the inward and outward projecting hooks of the second cover member latching section before the inward and outward projecting hooks of the first cover member latching section latch to inward and outward projecting hooks of the second cover member latching section.

4. The electrical connector as in claim 1, where the first cover member latching section and the second cover member latching section have hermaphrodite shapes relative to each other.

5. The electrical connector as in claim 1, where the first and second cover members form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section.

6. The electrical connector as in claim 1, further comprising at least one wedge, where the at least one wedge comprises a wedge section inserted between mating pairs of the inward and outward projecting hooks.

7. The electrical connector as in claim 1, where the first cover member and the second cover member are substantially identical and reversely orientated relative to each other.

8. The electrical connector of claim 1 in combination with:

a mating electrical connector comprising:

a second housing;

second electrical contacts connected to the second housing;

a second shield cover connected to the housing, where the second shield cover comprises a first cover member and a second cover member, where the second shield cover surrounds the second housing, where the first cover member of the second shield cover comprises a first cover member latching section comprising a first lateral side with inward projecting hooks and an opposite second lateral side with outward projecting hooks, where the second cover member of the second shield cover comprises a second cover member latching section comprising a first lateral side with inward projecting hooks and an opposite second lateral side with outward projecting hooks, where the first cover member of the second shield cover comprises a lateral side with a first extension extending inward into a first lateral side of the second housing, where the first extension extends into a mating connector receiving area of the second housing and comprises a front edge forming a stop for the electrical connector inserted into the mating connector receiving area of the second housing, and where the second cover member of the second shield cover comprises a lateral side with a second extension extending inward into a second lateral side of the second housing, where the second extension extends into the mating connector receiving area of the second housing and comprises a front edge forming a stop for the electrical connector inserted into the mating connector receiving area of the housing.

9. An electrical connector comprising:

a housing;

electrical contacts connected to the housing;

a shield cover connected to the housing, where the shield cover comprises a first cover member and a second cover member, where the shield cover surrounds the housing, where the first cover member comprises a first cover member latching section comprising a first lateral side with inward projecting hooks and an opposite second lateral side with outward projecting hooks, where the second cover member comprises a second cover member latching section comprising a first lateral side with inward projecting hooks and an opposite second lateral side with outward projecting hooks, where the first cover member latching section and the second cover member latching section have hermaphrodite shapes relative to each other.

10. An electrical connector comprising:

a housing;

electrical contacts connected to the housing;

a shield cover connected to the housing, where the shield cover comprises a first cover member and a second cover member, where the shield cover surrounds the housing, where the first and second cover members form a cable exit of the electrical connector, where the first cover member comprises a first half circular cable exit section with teeth and chambers at opposite ends of the first half circular cable exit section, where the second cover member comprises a second half circular cable exit section with teeth and chambers at opposite ends of the second half circular cable exit section, where the teeth of the first half circular cable exit section extend into the chambers of the second half circular cable exit section, and where the teeth of the second half circular cable exit section extend into the chambers of the first half circular cable exit section.

11. An electrical connector comprising:

a housing;

electrical contacts connected to the housing;

a shield cover connected to the housing, where the shield cover comprises a first cover member and a second cover member, where the shield cover surrounds the housing, where the first cover member comprises a lateral side with a first extension extending inward into a first lateral side of the housing, where the first extension extends into a mating connector receiving area of the housing and comprises a front edge forming a stop for a mating connector inserted into the mating connector receiving area of the housing, and where the second cover member comprises a lateral side with a second extension extending inward into a second lateral side of the housing, where the second extension extends into the mating connector receiving area of the housing and comprises a front edge forming a stop for the mating connector inserted into the mating connector receiving area of the housing.

* * * * *